US008258715B2

(12) United States Patent
Zhao et al.

(10) Patent No.: US 8,258,715 B2
(45) Date of Patent: Sep. 4, 2012

(54) FLUORESCENT LAMP WITH BALANCED LAMP TUBE ELECTRIC POTENTIALS

(75) Inventors: Li-Jun Zhao, Shenzhen (CN); Tong Zhou, Shenzhen (CN)

(73) Assignees: Innocom Technology (Shenzhen) Co., Ltd., Shenzhen, Guangdong Province (CN); Chimei Innolux Corporation, Miao-Li County (TW)

( * ) Notice: Subject to any disclaimer, the term of this patent is extended or adjusted under 35 U.S.C. 154(b) by 313 days.

(21) Appl. No.: 12/764,911

(22) Filed: Apr. 21, 2010

(65) Prior Publication Data

US 2011/0050114 A1 Mar. 3, 2011

(30) Foreign Application Priority Data

Aug. 31, 2009 (CN) ..... 2009 1 0306373

(51) Int. Cl.
*H05B 41/16* (2006.01)

(52) U.S. Cl. ..... 315/274; 315/278; 315/282; 315/312

(58) Field of Classification Search ..... 315/312, 315/276, 244, 318, 278, 274, 307, 297, 219, 315/177, 282, 277, 294, 324, 220
See application file for complete search history.

(56) References Cited

U.S. PATENT DOCUMENTS

| | | | | |
|---|---|---|---|---|
| 7,002,304 | B2 * | 2/2006 | Chan et al. | 315/282 |
| 7,230,390 | B2 * | 6/2007 | Wu | 315/213 |
| 7,242,151 | B2 * | 7/2007 | Chan et al. | 315/278 |
| 7,309,964 | B2 * | 12/2007 | Wey et al. | 315/312 |
| 7,319,297 | B2 * | 1/2008 | Kuo | 315/282 |
| 7,439,685 | B2 * | 10/2008 | Kim et al. | 315/277 |
| 7,525,258 | B2 * | 4/2009 | Kim et al. | 315/282 |
| 7,667,410 | B2 * | 2/2010 | Kim et al. | 315/274 |
| 7,759,877 | B2 * | 7/2010 | Bai et al. | 315/277 |

* cited by examiner

*Primary Examiner* — Vibol Tan
(74) *Attorney, Agent, or Firm* — WPAT, P.C.; Justin King

(57) ABSTRACT

A fluorescent lamp includes three transformers, a power supply, a converter, and four lamp tubes. The converter converts a direct current (DC) provided by the power supply into an alternating current (AC) generated in a first transformer and a second transformer for driving the four lamp tubes to emit light. The third transformer is connected to the four lamp tubes to balance working electric potentials of the four lamp tubes.

6 Claims, 4 Drawing Sheets

FLUORESCENT LAMP WITH BALANCED LAMP TUBE ELECTRIC POTENTIALS

BACKGROUND

1. Technical Field

The present disclosure relates to fluorescent lamps, and particularly to a fluorescent lamp capable of providing balanced driving electric potentials to a plurality of lamp tubes thereof.

2. Description of Related Art

Cold cathode fluorescent lamps (CCFL) are widely used in electronic displays as backlights. Referring to FIG. 3, one such CCFL driving circuit 1 generally includes a first transformer 10, a second transformer 12, a power supply 14, a converter 16, and four lamp tubes 18, 20, 22, 24. The first transformer 10 includes a first primary side 100 and a first secondary side 102. The second transformer 12 includes a second primary side 120 and a second secondary side 122. The power supply 14 is connected to the first primary side 100 and the second primary side 120. The converter 16 includes two transistors 161, 162 both connected to the first primary side 100 and the second primary side 120. The lamp tubes 18, 20 are respectively connected to two ends of the first secondary side 102. The lamp tubes 22, 24 are respectively connected to two ends of the second secondary side 122.

In use, the two transistors 160, 162 of the converter 16 are alternately turned on, such that a direct current (DC) provided by the power supply 14 periodically passes through the first primary side 100 and the second primary side 120. Thus, the DC is converted into a square wave alternating current (AC) passing through the first primary side 100 and the second primary side 120. The square wave AC generates a corresponding sine wave AC in the first secondary side 102 and the second secondary side 122, and the sine wave AC drives the lamp tubes 18, 20, 22, 24 to emit light.

For maximum light quality, in the CCFL 1, every pair of lamp tubes connected to the same transformer, such as the pair of lamp tubes 18, 20 both connected to the first transformer 10 or the pair of lamp tubes 22, 24 both connected to the second transformer 12, must be configured to exhibit identical parasitic parameters, such as capacitances, inductances, and other parameters. If any pair of lamp tubes connected to the same transformer exhibits different parameters, the light quality of the CCFL 1 may be adversely affected. For example, referring to FIG. 4, if the parasitic parameters of the lamp tubes 18, 20 are different from each other, when they are driven by the same sine wave AC provided by the first transformer 10, the sine wave AC may generate different electric potentials in the lamp tubes 18, 20. Thus, luminance among the lamp tubes 18, 20 may vary, adversely affecting light quality of the CCFL 1.

Therefore, there is room for improvement within the art.

BRIEF DESCRIPTION OF THE DRAWINGS

Many aspects of the present fluorescent lamp can be better understood with reference to the following drawings. The components in the various drawings are not necessarily drawn to scale, the emphasis instead being placed upon clearly illustrating the principles of the present fluorescent lamp. Moreover, in the drawings, like reference numerals designate corresponding parts throughout the figures.

DETAILED DESCRIPTION

Figure 1:
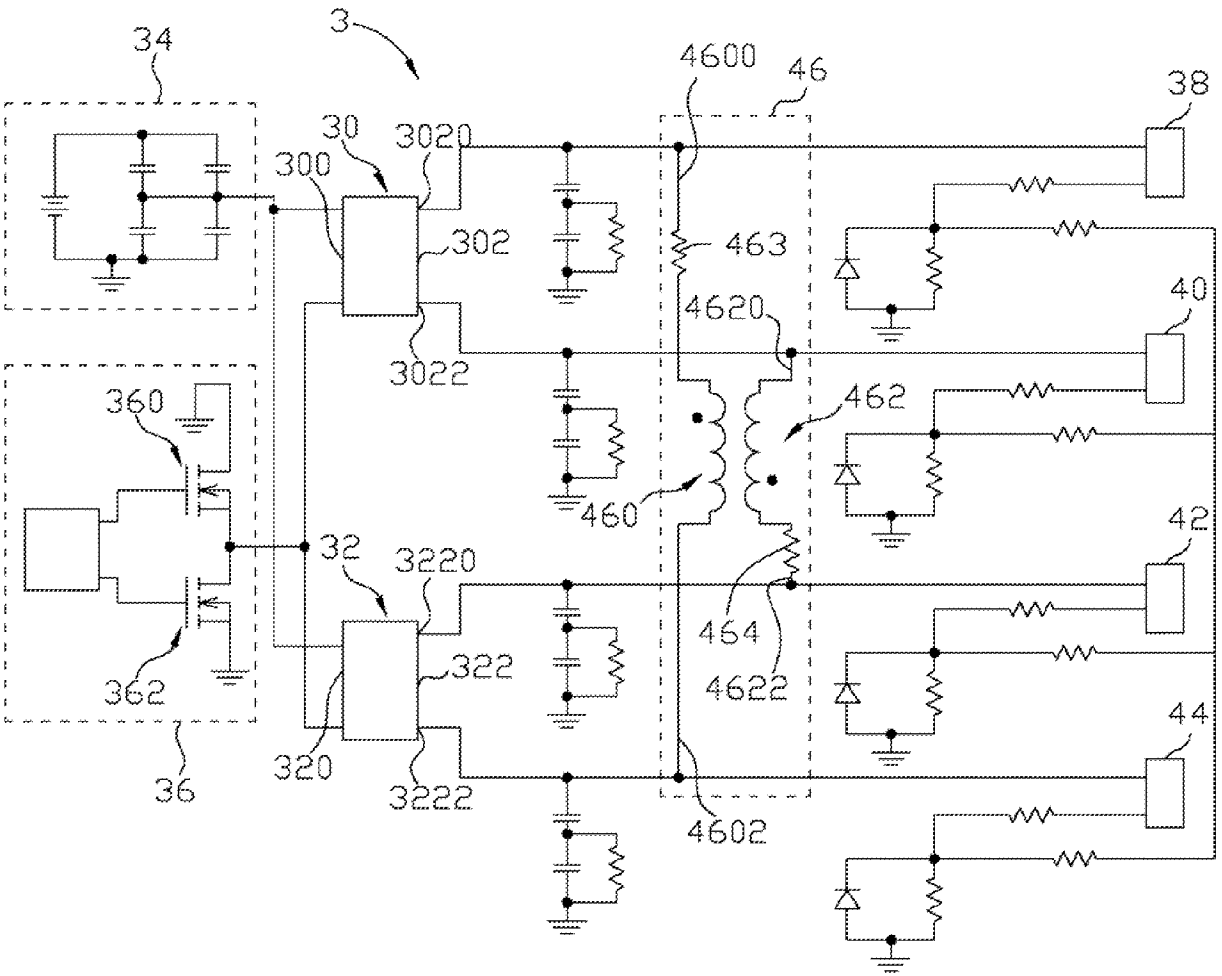
FIG. 1 is a circuit diagram of a fluorescent lamp, according to an exemplary embodiment.

Referring to FIG. 1, a fluorescent lamp 3, according to an exemplary embodiment, is shown. The fluorescent lamp 3 can be a CCFL, which includes a first transformer 30, a second transformer 32, a third transformer 46, a power supply 34, a converter 36, a first lamp tube 38, a second lamp tube 40, a third lamp tube 42, and a fourth lamp tube 44.

The first transformer 30 includes a first primary side 300 and a first secondary side 302. The second transformer 32 includes a second primary side 320 and a second secondary side 322. The power supply 34 is connected to the first primary side 300 and the second primary side 320. The converter 36 is a half-bridge converter, including two transistors 361, 362, both connected to the first primary side 300 and the second primary side 320. The first lamp tube 38 is connected to one end 3020 of the first secondary side 302, and the second lamp tube 40 is connected to another end 3022 of the first secondary side 302. The third lamp tube 42 is connected to one end 3220 of the second secondary side 322, and the fourth lamp tube 44 is connected to another end 3222 of the second secondary side 322.

The third transformer 46 includes a third primary side 460 and a third secondary side 462. The number of turns in the third primary side 460 and the third secondary side 462 are equal. The third primary side 460 has one end 4600 connected between the end 3020 of the first transformer 30 and the first lamp tube 38, and another end 4602 connected between the end 3222 of the second transformer 32 and the fourth lamp tube 44. The third secondary side 462 has one end 4620 connected between the end 3022 of the first transformer 30 and the second lamp tube 40, and another end 4622 connected between the end 3220 of the second transformer 32 and the third lamp tube 42. Thus, the third primary side 4660 is connected between the first lamp tube 38 and the fourth lamp tube 44, and the third secondary side 462 is connected between the second lamp tube 40 and the third lamp tube 42.

In use, the two transistors 360, 362 of the converter 36 are alternately turned on, such that a DC provided by the power supply 34 periodically passes through the first primary side 300 and the second primary side 320. Thus, the DC is converted to a square wave AC passing through the first primary side 300 and the second primary side 320. The square wave AC generates a corresponding sine wave AC in the first secondary side 302 and the second secondary side 322, where the sine wave AC drives the lamp tubes 38, 40, 42, 44 to emit light.

When any pair of lamp tubes both connected to either of the first transformer 30 or the second transformer 32, such as the pair of lamp tubes 38, 40 both connected to the first transformer 30 or the pair of lamp tubes 42, 44 both connected to the second transformer 32, exhibit different parasitic parameters, such as capacitances, inductances, and others, the third transformer 46 can cooperate with the other pair of lamp tubes, both of which are connected to the first transformer 30 or the second transformer 32 and exhibit similar parameters, to regulate the electric potentials of the two lamp tubes exhibiting different parameters, such that the working electric potentials of the lamp tubes 38, 40, 42, 44 are balanced and the fluorescent lamp 3 continues to emit even light.

Figure 2:
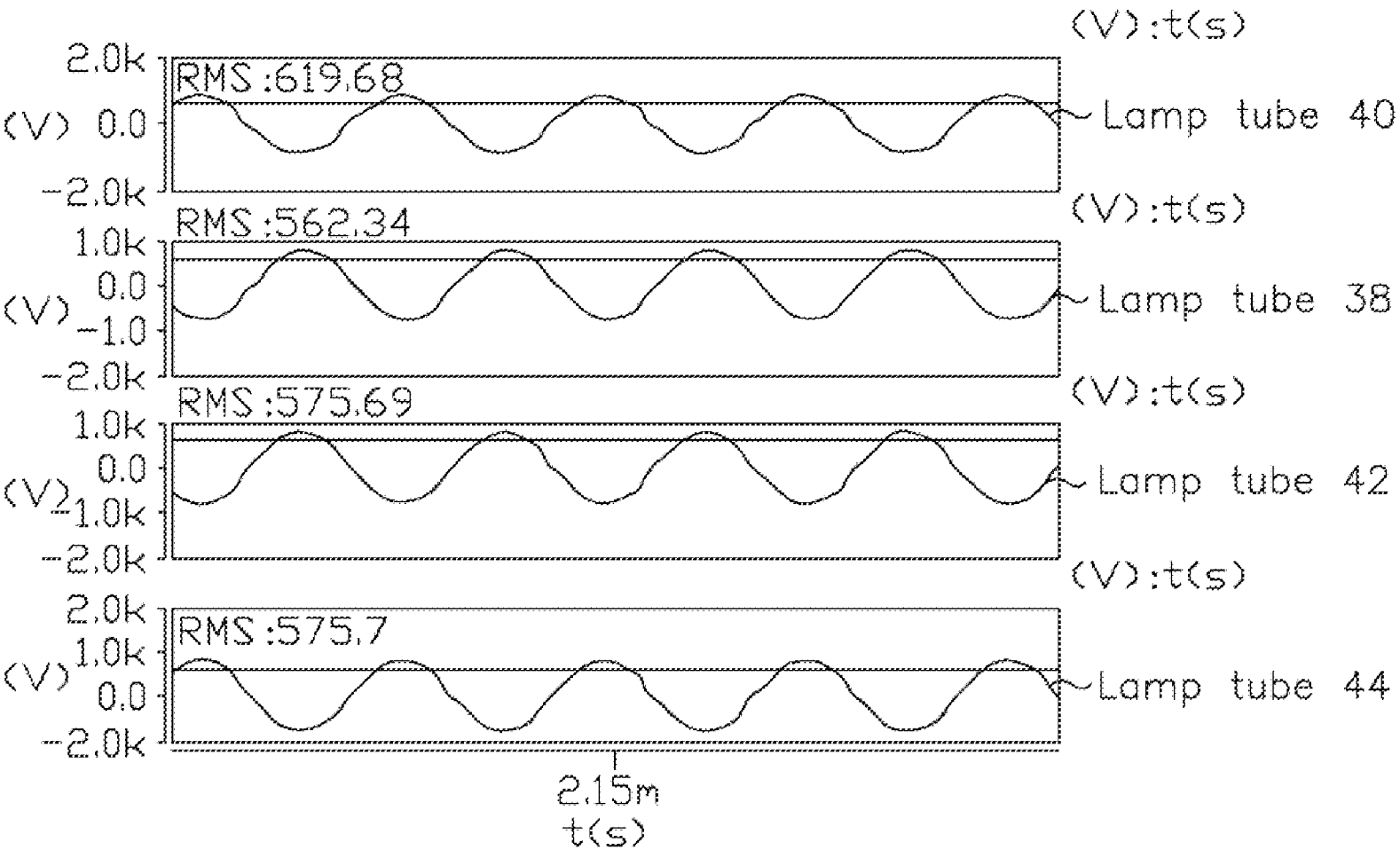
FIG. 2 is an electric potential diagram of lamp tubes of the fluorescent lamp shown in FIG. 1.
Figure 3:
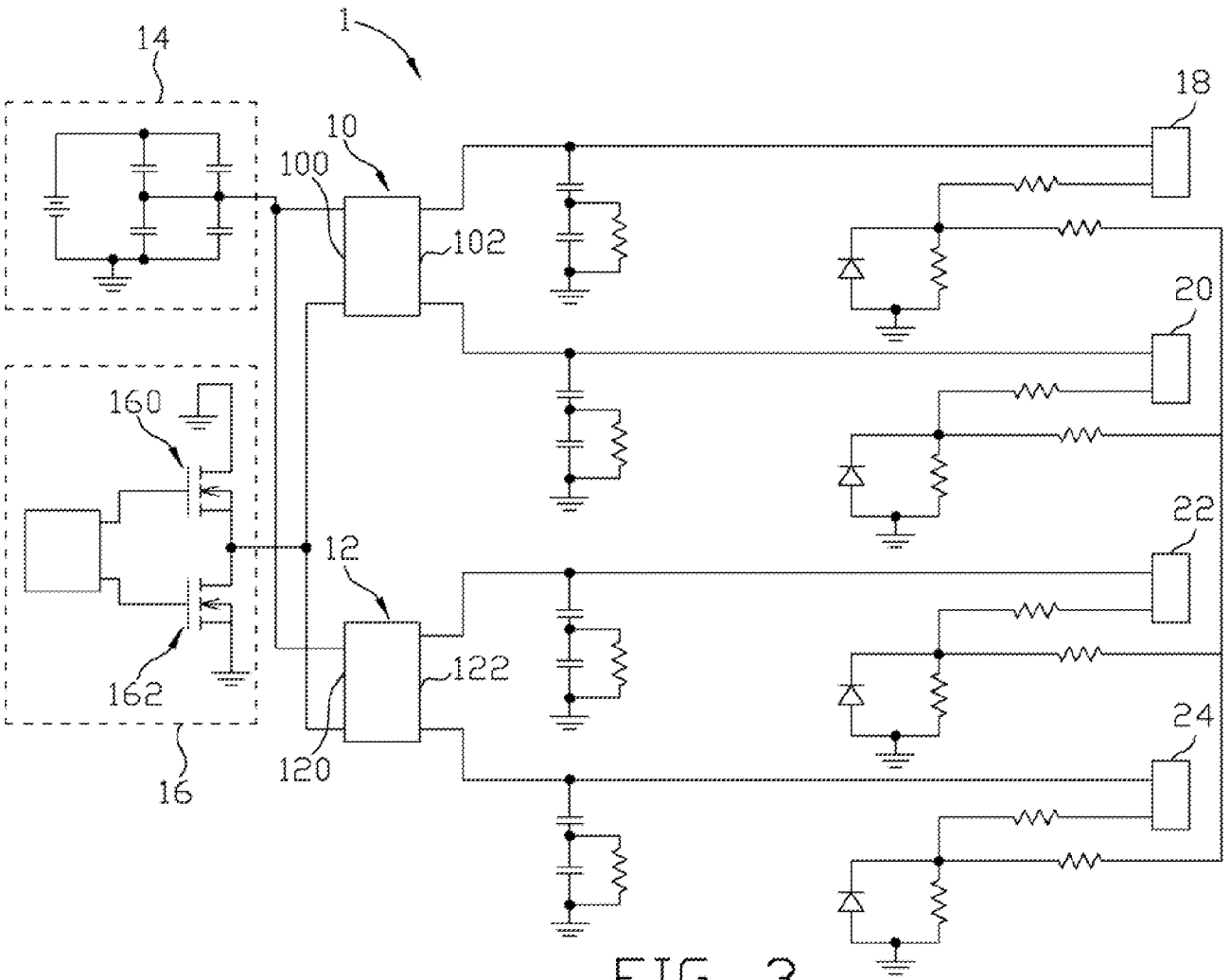
FIG. 3 (RELATED ART)
FIG. 3 is a circuit diagram of a commonly used fluorescent lamp.
Figure 4:
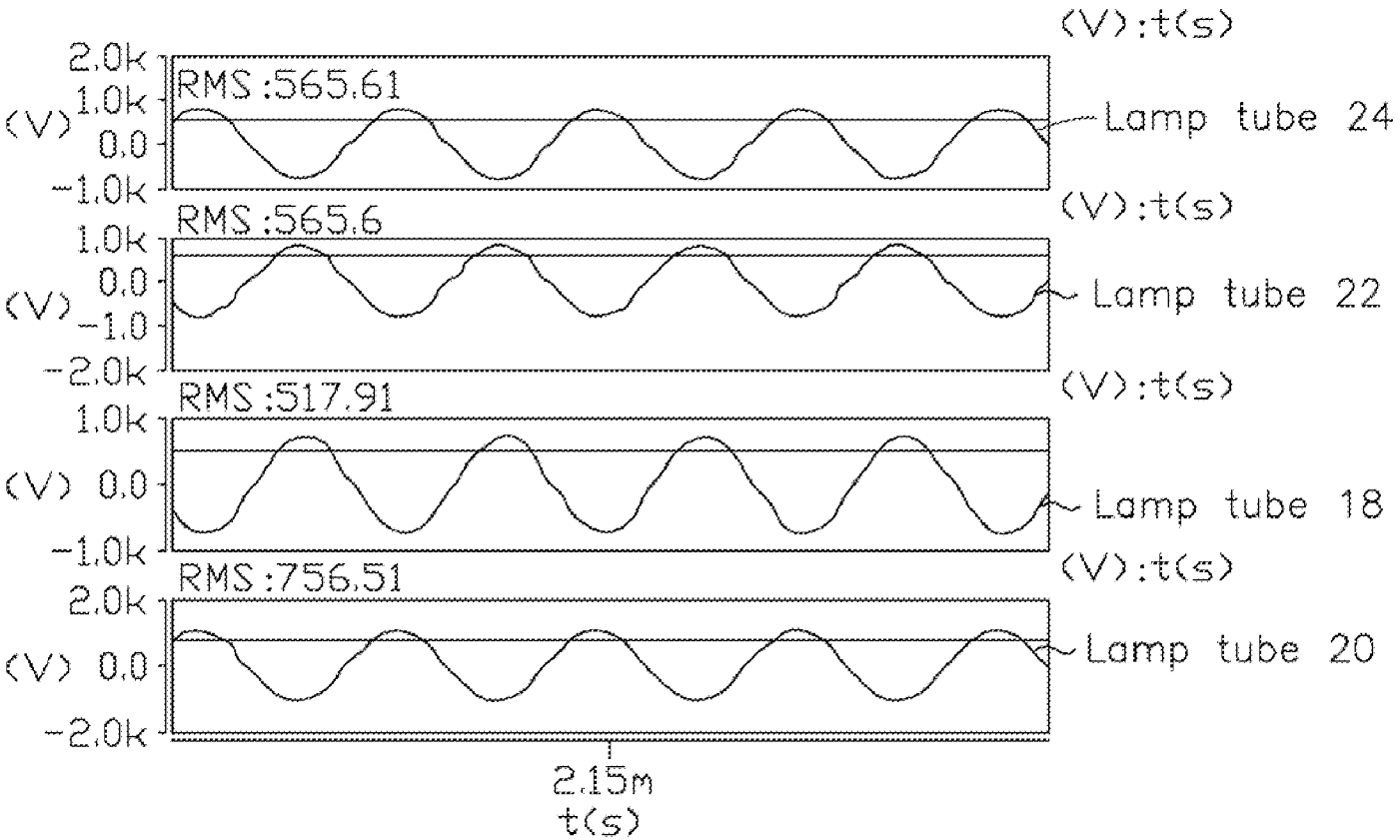
FIG. 4 (RELATED ART)
FIG. 4 is an electric potential diagram of lamp tubes of the fluorescent lamp shown in FIG. 3.

For example, referring to FIG. 2, the first lamp tube 38 and the second lamp tube 40 both connected to the first transformer 30 can exhibit different parasitic parameters, and the third lamp tube 42 and the fourth lamp tube 44 both connected to the second transformer 32 exhibit similar parasitic parameters. In use, the electric potentials of the third lamp tube 42 and the fourth lamp tube 44 are both provided by the second transformer 32, and the third lamp tube 42 and the fourth lamp tube 44 have similar parasitic parameters, therefore, the electric potentials of the third lamp tube 42 and the fourth lamp tube 44 are similar. Furthermore, since the number of turns in the third primary side 460 and the third secondary side 462 are equal, the electric potential difference between the two ends 4620, 4622 of the third secondary side 462, that is the electric potential difference between the second lamp tube 40 and the third lamp tube 42, is regulated to equal the electric potential difference between the two ends 4600, 4602 of the third primary side 460, that is the electric potential difference between the first lamp tube 38 and the fourth lamp tube 44. Thus, it can be inferred that the electric potentials of the first lamp tube 38 and the second lamp tube 40 are regulated to be similar to each other, and thus the working electric potentials of the lamp tubes 38, 40, 42, 44 are balanced. Despite the first lamp tube 38 and the second lamp tube 40 exhibiting different parasitic parameters, they still receive similar working electric potentials and emit light in similar luminance. In this way, the fluorescent lamp 3 emits uniform light, thereby maximizing light quality.

Alternatively, the third primary side 460 and the third secondary side 462 of the third transformer 46 can be interchanged with each other. Particularly, the end 4600 is connected between the end 3022 of the first transformer 30 and the second lamp tube 40, the end 4620 is connected between the end 3020 of the first transformer 30 and the first lamp tube 38, the end 4602 is connected between the end 3220 and the third lamp tube 42, and the end 4622 is connected between the end 3222 and the fourth lamp tube 44. Thus, the third primary side 4660 is connected between the second lamp tube 40 and the third lamp tube 42, and the third secondary side 462 is connected between the first lamp tube 38 and the fourth lamp tube 44. However, the changed fluorescent lamp 3 can also be used according to the method described. In either case, the two lamp tubes connected to the same side of the third transformer 46, that is the third primary side 460 or the third secondary side 462, are respectively connected to the first transformer 30 and the second transformer 32. In this way, despite one pair of lamp tubes both connected to either of the first transformer 30 or the second transformer 32 exhibiting different parasitic parameters, if only the other pair of lamp tubes both connected to another of the first transformer 30 or the second transformer 32 have similar parameters, the third transformer 46 can cooperate with the pair of lamp tubes exhibiting similar parameters to regulate the electric potentials of the two lamp tubes exhibiting different parameters, such that the fluorescent lamp 3 continues to emit uniform light.

The converter 36 can also be a full-bridge converter, a push-pull converter, or other. Additionally, for conserving power consumption of the fluorescent lamp 3, the third transformer 46 can further include a current-limiting resistor 463/464 connected to either of the third primary side 460 and the third secondary side 462, or include two current-limiting resistors 463, 464 respectively connected to the third primary side 460 and the third secondary side 462, as shown in FIG. 1. Two ends of the current-limiting resistor 463 can be respectively connected to the third primary side 460 and either of the two lamp tubes connected to the third primary side 460, i.e., respectively connected to one end of the third primary side 460 and the first lamp tube 38, or respectively connected to another end of the third primary side 460 and the fourth lamp tube 44. Two ends of the current-limiting resistor 464 can be respectively connected to the third secondary side 462 and either of the two lamp tubes connected to the third secondary side 462, i.e., respectively connected to one end of the third secondary side 462 and the second lamp tube 40, or respectively connected to another end of the third secondary side 462 and the third lamp tube 42.

It is to be further understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. A fluorescent lamp, comprising:

a first transformer including a first primary side and a first secondary side;

a second transformer including a second primary side and a second secondary side;

a power supply connected to the first primary side and the second primary side;

a converter connected to the first primary side and the second primary side;

a first lamp tube and a second lamp tube both connected to the first secondary side;

a third lamp tube and a fourth lamp tube both connected to the second secondary side; and a third transformer including a third primary side and a third secondary side, the first lamp tube and the fourth lamp tube both connected to one of the third primary side and the third secondary side, and the second lamp tube and the third lamp tube both connected to another of the third primary side and the third secondary side.

2. The fluorescent lamp as claimed in claim 1, wherein the converter converts a direct current (DC) provided by the power supply to an alternating current (AC) generated in the first transformer and the second transformer for driving the first lamp tube, the second lamp tube, the third lamp tube, and the fourth lamp tube to emit light.

3. The fluorescent lamp as claimed in claim 1, wherein the converter is a half-bridge converter, a full-bridge converter, or a push-pull converter.

4. The fluorescent lamp as claimed in claim 1, wherein the number of turns in the third primary side and the third secondary side are equal.

5. The fluorescent lamp as claimed in claim 1, wherein the third transformer further includes a current-limiting resistor connected to either of the third primary side and the third secondary side, two ends of the current-limiting resistor respectively connected to the third primary side and either of the two lamp tubes connected to the third primary side, or respectively connected to the third secondary side and either of the two lamp tubes connected to the third secondary side.

6. The fluorescent lamp as claimed in claim 1, wherein the third transformer further includes two current-limiting resistors respectively connected to the third primary side and the third secondary side, two ends of one current-limiting resistor respectively connected to the third primary side and either of the two lamp tubes connected to the third primary side, and two ends of the other current-limiting resistor respectively connected to the third secondary side and either of the two lamp tubes connected to the third secondary side.

* * * * *